US005841049A

United States Patent [19]

Strawn

[11] Patent Number: 5,841,049

[45] Date of Patent: Nov. 24, 1998

[54] MUSICAL PERCUSSION INSTRUMENT

[76] Inventor: Carroll Glenn Strawn, Route 1 Box 23, Teachland, N.C. 28133

[21] Appl. No.: 587,206

[22] Filed: Jan. 16, 1996

[51] Int. Cl.[6] ..... G10D 13/02; G10G 5/00

[52] U.S. Cl. ..... 84/411 R; 84/412; 84/421

[58] Field of Search ..... 84/411 R, 412, 84/413, 421

[56] References Cited

U.S. PATENT DOCUMENTS

| | | | |
|---|---|---|---|
| 3,865,003 | 2/1975 | Della-Porta | 84/411 |
| 3,911,779 | 10/1975 | Della-Porta | 84/411 |
| 4,289,056 | 9/1981 | Shier | 84/412 |
| 4,312,259 | 1/1982 | Henrit | 84/411 A |
| 4,520,709 | 6/1985 | Kester, Jr. | 84/415 |
| 4,660,455 | 4/1987 | Jones et al. | 84/143 |
| 4,714,002 | 12/1987 | Cleland | 84/413 |
| 4,869,146 | 9/1989 | Bonsor | 84/413 |
| 4,967,634 | 11/1990 | Whynott | 84/413 |
| 5,410,938 | 5/1995 | Kurosaki et al. | 84/411 R |
| 5,447,087 | 9/1995 | Hawes et al. | 84/413 |

FOREIGN PATENT DOCUMENTS 2203 12/1903 United Kingdom .

*Primary Examiner*—John W. Cabeca
*Assistant Examiner*—Marlon T. Fletcher

[57] ABSTRACT

Disclosed is a percussion instrument comprising a first mounting ring, a second mounting ring, a shell between the first and second mounting rings, and means for connecting the first and second mounting rings and for preventing transmission of axial loads to the shell. One means for decoupling the shell from axial loads comprises means for connecting the first and second mounting rings and for defining a minimum axial distance between the mounting rings which is greater than the axial length of the shell.

25 Claims, 4 Drawing Sheets

MUSICAL PERCUSSION INSTRUMENT

This invention relates to musical percussion instruments, and more particularly to a percussion instrument having a unique and beneficial configuration and construction.

In general, musical percussion instruments, such as orchestral snare drums and the like, utilize at least one tensioned vibratory membrane in combination with a drum shell. In use, the vibratory membrane, commonly referred to as the "drum head" or "batter head," is struck by a drum player, which causes the drum head and the drum shell to vibrate together to produce the desired musical sound. One critical aspect of the musical sound which is produced is the degree of tension under which the drum head is placed. In embodiments involving snare drums and the like, for example, it is frequently desirable to have a highly tensioned batter head.

According to many conventional configurations, this tensioning is achieved by stretching the drum head directly across an open end of the drum shell. Such a configuration is shown, for example, in U.S. Pat. No. 4,660,455—Jones et al. Related constructions are shown in U.S. Pat. No. 3,865,003—Della-Porta; U.S. Pat. No. 3,911,779—Della-Porta; and U.S. Pat. No. 4,967,634—Whynott.

In many drum configurations, particularly snare drum configurations, two vibratory membranes are utilized: one membrane is intended for direct contact by the player of the instrument (usually referred to as the "batter head") while the second membrane is stretched across or adjacent to the other opening (usually the bottom opening) of the drum shell. Several constructions have been developed to enable tensioning of the top or batter head independently of the tension on the bottom head. Such constructions are disclosed, for example, in U.S. Pat. No. 4,714,002—Cleland; U.S. Pat. No. 4,869,146—Bonsor; and U.S. Pat. No. 5,410,938—Kurosaki et al.

Applicants have recognized that drum constructions of the type heretofore known have resulted in the placement of undesirable compressive axial loads on the drum shell. Applicants have also recognized that the tonal quality of the percussion instrument can be maximized by eliminating the shell as a structural component of the drum. Such an arrangement permits the percussion instrument designer to select the materials and dimensions used for the shell based solely on musical performance considerations.

According to prior art techniques, the use of the shell as a structural component of the percussion instrument has frequently required that the shell be connected, mounted and/or otherwise attached to other components of the instrument. This is undesirable because any attachment of the drum shell to structural components can interfere with the desired vibration and musical properties of the shell.

Accordingly, it is an object of the present invention to provide a percussion instrument in which tensioning of the vibratial membrane does not result in the exertion of damaging axial stress on the drum shell.

It is a further object of the present invention to provide a drum configuration in which the drum shell can be readily and rapidly changed by the user of the drum.

It is yet a further object of the present invention to provide a percussion instrument in which the drum shell is structurally decoupled from the remaining elements of the instrument.

SUMMARY OF THE INVENTION

Applicants have discovered that these and other objects can be achieved by the provision of a percussion instrument comprising: a first mounting ring; a second mounting ring; a shell contained between said first and second mounting rings; and means for connecting said first and second mounting rings and for preventing the transmission of axial loads to the shell. One such means for decoupling the shell from axial loads comprises means for connecting said first and second mounting rings and for defining a minimum axial distance between the mounting rings which is greater than axial length of the shell. In this way, the present invention provides a percussion instrument in which the shell is captured, and preferably movably captured, between the first and second mounting rings such that axial loads transmitted between and/or to said first and second mounting rings are not transmitted to the shell.

BRIEF DESCRIPTION OF DRAWINGS

These and other features, aspects and advantages of the present invention will become better understood with reference to the following description taken with the accompanying drawings, in which.

DESCRIPTION OF THE PREFERRED EMBODIMENT

The present invention is directed to musical percussion instruments, and in particular to musical drums such as snare drums and the like. Although it is contemplated that numerous types and configurations of percussion instruments can benefit from utilization of the present invention, it is believed that the descriptions herein can be used to especially great advantage in the design and construction of snare drums. This is so because the batter heads used in snare drums and the like are usually subject to extremely high tensioning, which has heretofore frequently resulted in damage to the drum shell. Thus, for the purposes of convenience and illustration, the present invention will generally be described and illustrated in connection with an embodiment comprising a snare drum.

Figure 1:
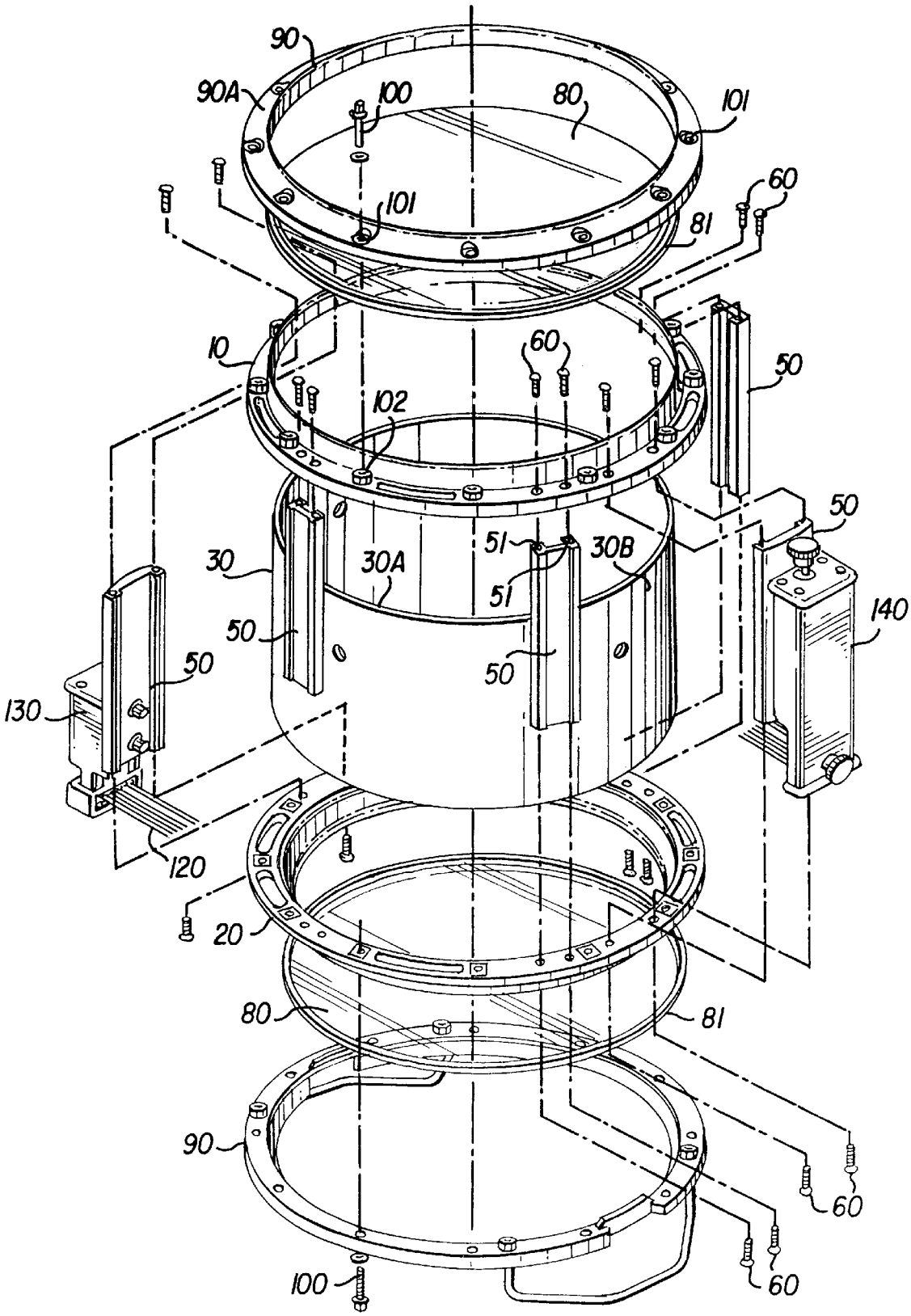
FIG. 1 is an exploded perspective view of one preferred embodiment of the invention.
Figure 2:
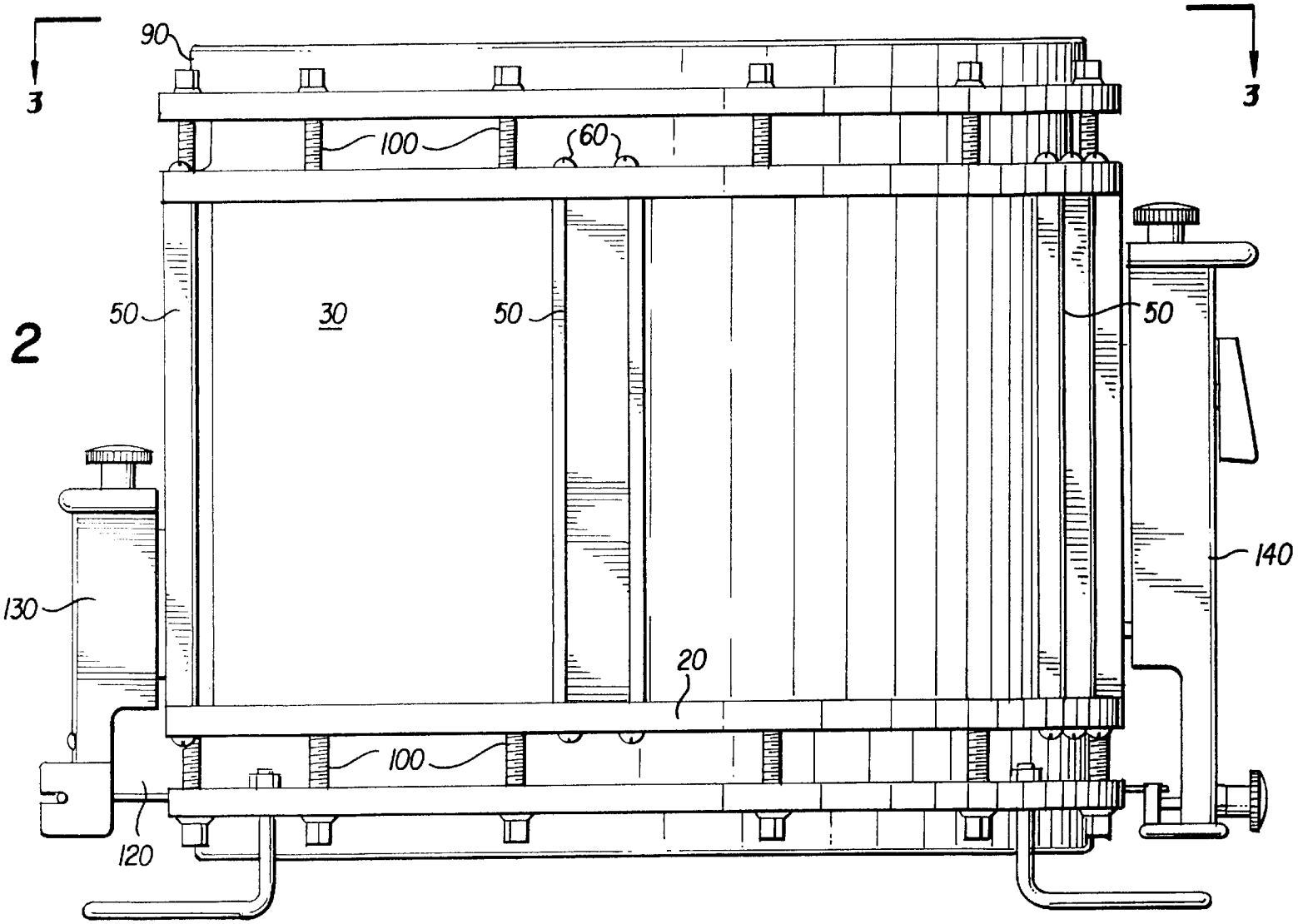
FIG. 2 is a elevation view of the preferred embodiment illustrated in FIG. 1.

With particular reference now to FIGS. 1 and 2, a preferred percussion instrument in accordance with the present invention comprises a first mounting ring 10, a second mounting ring 20, and a drum shell 30. Although cylindrical rings and shells are commonly and conventionally used and are shown in the figures hereof, it will be appreciated by those skilled in the art that non-cylindrical shapes may be used according to certain embodiments. Thus, the terms "ring" and "shell" are not intended to necessarily be limited to circular or cylindrical rings and shells but to encompass alternative shapes.

In general, it is contemplated that shell 30 will comprise a cylindrical member of substantially uniform axial and radial dimension. Those skilled in the art will appreciate, however, that embodiments which employ a shell of a non-uniform axial dimension may also be utilized in accordance with the present invention. For example, it is contemplated that in certain embodiments one or more edges of the shell may define a partial frusto-conical shape in which the axial length in one portion of the shell is less than the axial length of another portion of the shell. Such a configuration may be utilized, for example, to obtain a percussion instrument with a slanted or inclined batter head.

The mounting rings 10 and 20 perform at least two important functions in the musical percussion instruments of the present invention. First, the mounting rings 10 and 20 together preferably contain and capture the drum shell 30. Second, the mounting rings of the present invention also preferably provide an opening over which the membranes of the percussion instrument are stretched.

Important and critical to the operation of the preferred embodiments of the present invention is the provision of means for connecting the first and second mounting rings such that any axial loads applied between or to the mounting rings is structurally decoupled from the drum shell 30. In other words, the preferred connecting means of the present invention provide means for substantially preventing the transmission of axial loads from one or more of the mounting rings to the shell.

In the embodiment shown in the figures hereof, the connecting means of the present invention comprises a plurality of load posts 50 fixedly disposed between and attached to mounting rings 10 and 20. The load posts 50 are preferably spaced around the circumference of the drum shell so as to substantially evenly distribute the axial loads on the posts 50. The preferred load posts 50 establish and define a minimum axial distance between the shell engaging portions of the first mounting ring 10 and the shell engaging portions of the second mounting ring 20. Since the minimum distance established by load posts 50 is greater than the axial extent of shell 30, the percussion instrument of the present invention exhibits the highly desirable and beneficial feature of having a shell which carries no axial load under even the most severe tensioning conditions. That is, any and all axial loads transmitted to or between the first and second mounting rings are carried by load posts 50.

It will be appreciated by those skilled in the art that a plurality of minimum distances may be established in accordance with the present invention. More particularly, a plurality of minimum distances may be established, for example, when a partially frusto-conically shaped shell is utilized to obtain a slanted or inclined orientation for the batter head. In such configurations, the plural load posts together will establish an angle of incline associated with the batter head. Furthermore, each load post 50 will establish and define a separate minimum axial distance corresponding to the separate and distinct axial extent of the shell in the area corresponding to each load post 50.

Figure 4:
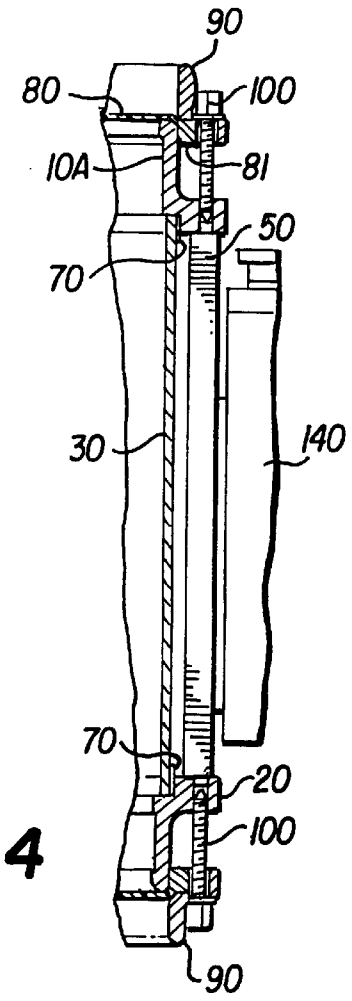
FIG. 4 is cross sectional view taken along lines 4—4 of FIG. 3.
Figure 3:
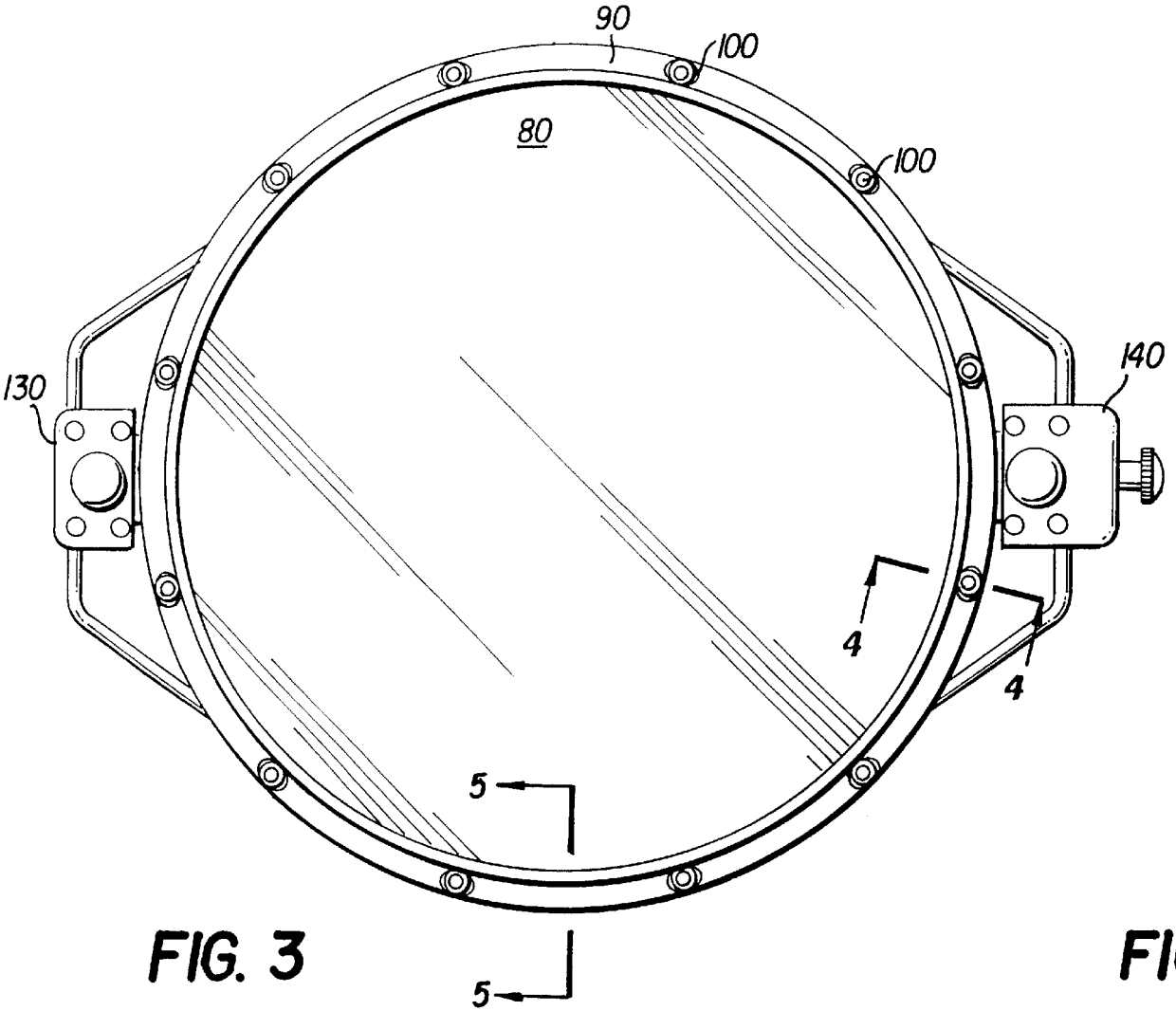
FIG. 3 is a plan view of the preferred embodiment illustrated in FIG. 2 and taken along lines 3—3 of FIG. 2.
Figure 5:
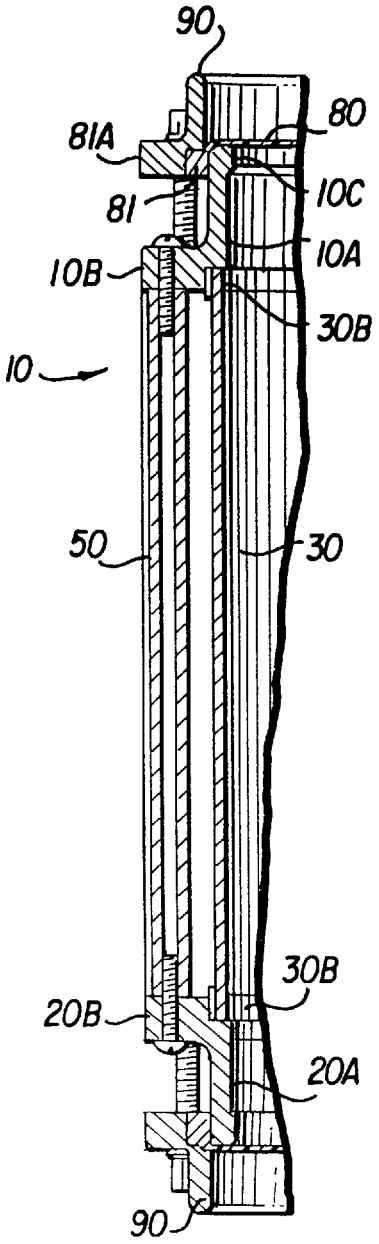
FIG. 5 is cross sectional view taken along lines 5—5 of FIG. 3.

With particular reference now to FIGS. 4 and 5, the means utilized in the illustrated embodiment for structurally decoupling the shell from the percussion instrument is illustrated in detail. More particularly, the first mounting ring, indicated generally at 10, comprises an axial sidewall portion 10A and a depending, radially extending flange portion 10B. The bottom ring, indicated generally at 20, comprises a similar arrangement of side wall 20A and radial flange 20B. An internal annular groove or stepped portion is preferably formed at the internal transition between the axial sidewalls 10A/20A and the radial flanges 10B/20B of the top ring 10 and the bottom ring 20. The annular slot or groove in ring 10 is configured and adapted to engage the top edge portion 30A and a portion of the sidewall 30B of the shell (see FIG. 1). A similar arrangement is preferably employed in connection with mounting ring 20. Thus, the internal annular slot or groove defines the shell engaging portion of the first and second mounting rings.

According to important and critical aspects of the present invention, mounting means 50 define a minimum axial distance between the shell-engaging surfaces of the first and second mounting rings which is greater than the axial extent of shell 30. That is, the longitudinal or axial distance between the ends of load posts 50 establishes the minimum distance between the flange portions 10B and 20B of the mounting rings, which in turn establishes the minimum distance between the shell-engaging portions of the first and second mounting rings.

Although it is contemplated that numerous and varied configurations may be used for load posts 50, the preferred load posts of the present invention are configured as slotted rectangular beams having two threaded channels 51 in each end thereof. Furthermore, it is contemplated that numerous types of materials of construction may be used to form load posts 50. In general, it is required only that the load members 50 have sufficient strength and rigidity to maintain the minimum distance between the first and second mounting rings while carrying the maximum axial loads expected for the drum. In general, however, it is preferred that the load members 50 be formed from an aluminum extrusion.

Various methods and mechanisms are available to those skilled in the art for mounting the first mounting ring 10 to the second mounting ring 20 utilizing load members 50, and all such mounting techniques are within the broad scope of the present invention. In the particular configuration illustrated in the figures, this connection is achieved by providing the radially extending flanged portions 10B/20B of the mounting rings 10/20 with pass-through apertures adapted to accept conventional bolts, machine screws and the like 60. The bolts 60 pass through the apertures in the annular flanges 10B/20B in the mounting rings 10/20 and engage threaded channels 51 in load posts 50 (see FIG. 1). In this fashion, a rigid structural frame which is independent of and decoupled from the shell 30 is obtained.

As will be appreciated by those skilled in the art, the percussion instrument of the present invention not only provides the beneficial advantage of a zero-load drum shell, it also affords the highly desirable ability to reconfigure the percussion instrument with alternative drum shells. Since the drum shell is not a structural part of the percussion instrument, such a change of drum shell may be readily achieved by demounting, for example, the top mounting ring 20, sliding out the existing drum shell, installing a new shell, and remounting ring 20. This type of operation may be desirable, for example, when a different color shell is desired. Other changes in shell configuration, such as shell material and shell wall thickness, may be readily and rapidly achieved in this fashion. Thus, the present invention provides yet a further advantage which is not feasible according to prior art products.

Because of the unique configuration associated with the percussion instrument of the present invention, the drum shell 30 is preferably movably contained within and captured by the first mounting ring 10 and the second mounting ring 20. In general, it is preferred that the axial length of the drum shell is only slightly smaller than the minimum distance between the first mounting ring and the second mounting ring. For example, it is contemplated that the gap or tolerance between these two distances is generally from about 1/32 to about 1/16 of an inch. In such configurations, therefore, the movability of the shell in the axial direction is nil. On the other hand, it is preferred that a liner or strip of material 70 (see FIG. 4) be provided in the radial gap or tolerance between the outer surface of the drum shell 30 and its associated mounting ring engaging portion. Because the strip or liner 70 is preferably formed from a relatively compressive, low-friction material, such as felt, the drum shell of the present invention is preferably rotatably moveable relative to the remaining structure of the percussion instrument. As used herein, the term moveable refers to the ability to move or rotate the drum shell without altering or modifying the structural integrity of the percussion instrument. According to the preferred embodiments of the present invention, such rotation of the drum shell can be readily achieved by the action of the drummer's hand on the drum shell.

The unique configuration described herein permits the use of any known means for mounting a batter head to the first mounting ring without exerting any axial load on the drum shell 30, and accordingly all such means are contemplated by and within the scope of the present invention. In general, however, a floating head arrangement of the type shown in the figures hereof is generally preferred. More particularly, the percussion instrument of the present invention preferably includes a batter head 80 which is sized and adapted to be tensioned across the top of sidewall 10A of mounting ring 10. For this purpose, it is preferred that the top edge of sidewall 10A comprise a bearing edge 10C adapted to smoothly and non-destructively engage membrane 80. The batter head 80 preferably includes a flesh hoop 81 secured to the annular edge of the membrane.

The means for mounting the batter head 80 preferably comprises a counter hoop 90 adapted to fit over the sidewall 10B of mounting ring 10 and to engage the flesh hoop 81. The batter head 80 is tensioned across the mounting ring 10 by a plurality of spaced tensioning bolts 100 which extend through apertures 101 in the flanged portion 90A of counter hoop 90 and into threaded receptacles 102 in the flanged portion of the first mounting ring 10. Such a configuration is particularly advantageous because the batter head assembly, which includes the mounting ring 10, the batter head 80 and the counter hoop 90, can be demounted without untensioning of the batter head, thereby facilitating removal and/or replacement of the drum shell 30. Such embodiments may include, for example, utilizing bolts 60 with hexheads or by incorporating apertures in counterhoop 90 for access to the heads of bolts 60.

Numerous types and configurations of tensioning bolts 100 may be used. It is generally preferred, however, that the bolts 100 are provided with a head that is key adjustable by a standard drum key.

Although it is contemplated that a bottom vibratial membrane may not be needed or required, the preferred embodiment incorporates a tensioned membrane 80 mounted in accordance with the same type of assembly describe hereinbefore in connection with the upper batter head.

Another optional feature of the percussion instrument according to the present invention is the provision of snappy cords 120 which extend transversely of and contact the lower drum head 80. Snare strainers 130 and 140 are preferably mounted to transversely disposed members 50 in order to hold the snappy cords 120 in tension.

What is claimed is:

1. A percussion instrument comprising:

(a) a first mounting ring having a first groove therein;

(b) a second mounting ring having a second groove therein;

(c) means for mounting a batter head under tension over at least said first mounting ring;

(d) means for connecting said first and second mounting rings together and for defining an axial distance between the first and second grooves of said mounting rings; and (e) a shell having axial ends disposed in the grooves of said first and second mounting rings and having an axial dimension between said axial ends less than the axial distance between the grooves of said mounting rings such that there is an axial spacing between at least one of said ends and the adjacent one of said grooves whereby axial loads are prevented by said axial spacing from being transmitted to said shell.

2. The percussion instrument of claim 1 wherein said first and second mounting rings are circular mounting rings.

3. The percussion instrument of claim 1 wherein said shell is a substantially cylindrical shell.

4. The percussion instrument of claim 1 further comprising a batter head tensioned over said first mounting ring.

5. The percussion instrument of claim 4 further comprising a second membrane tensioned over said second mounting ring.

6. The percussion instrument of claim 1 wherein said means for connecting comprises a plurality of load posts which establish the axial distance between said first ring and said second ring.

7. The percussion instrument of claim 6 wherein said load posts are formed from an aluminum extrusion.

8. The percussion of claim 1 wherein said means for mounting comprises: said membrane including a flesh hoop; and a counter hoop in tensioning engagement with said flesh hoop.

9. The percussion instrument of claim 1, wherein said shell is fitted in the grooves of said mounting rings so as to be rotatable relative to said mounting rings.

10. The percussion instrument of claim 9, including a liner of compressive, low-friction material disposed in each of said grooves adjacent each axial end of said shell.

11. A percussion instrument comprising:

(a) a first mounting ring;

(b) a second mounting ring;

(c) means for mounting a batter head under tension over at least said first mounting ring;

(d) a shell having an axial dimension defined by opposite axial ends of said shell, said shell being disposed between said first and second mounting rings; and (e) means for connecting said first and second mounting rings together at a fixed axial distance such that there is an axial spacing between at least one axial end of said shell and the adjacent one of said mounting rings whereby axial loads are prevented by said axial spacing from being transmitted to said shell.

12. The percussion instrument of claim 11 wherein said first and second mounting rings are circular mounting rings.

13. The percussion instrument of claim 11 wherein said shell is a substantially cylindrical shell.

14. The percussion instrument of claim 11 further comprising a batter head tensioned over said first mounting ring.

15. The percussion instrument of claim 14 further comprising a second membrane tensioned over said second mounting ring.

16. The percussion instrument of claim 11 wherein said means for connecting comprises a plurality of load posts which establish the fixed axial distance between said first ring and said second ring.

17. The percussion instrument of claim 16 wherein said load posts are formed from an aluminum extrusion.

18. The percussion instrument of claim 11 wherein said means for mounting comprises said membrane including a flesh hoop and a counter hoop in tensioning engagement with said flesh hoop.

19. The percussion instrument of claim 11, wherein said shell is fitted to said mounting rings so as to be rotatable relative to said mounting rings.

20. The percussion instrument of claim 19, including a liner of compressive, low-friction material disposed between each of said mounting rings and each axial end of said shell.

21. A percussion instrument comprising:

(a) a first mounting ring having an annular groove with a shoulder portion;

(b) a second mounting ring having an annular groove with a shoulder portion;

(c) means for mounting a batter head under tension over at least said first mounting ring; and (d) an annular shell having opposite axial ends captured between the shoulder portions of the annular grooves in said first and second mounting rings such that said shell is rotatable in said grooves relative to said first and second mounting rings and axial loads transmitted between said first and second mounting rings are not transmitted to said shell.

22. The percussion instrument of claim 21 wherein said mounting means comprises means substantially independent of said shell for mounting a drum head membrane under tension.

23. The percussion instrument of claim 21 comprising means for demountably connecting said first and second mounting rings and for removably retaining said shell between and in contact with said mounting rings such that axial loads placed on said first or second mounting rings are substantially completely carried by said connecting means.

24. The percussion instrument of claim 21, including a liner of compressive, low-friction material disposed in each of said grooves adjacent each axial end of said shell.

25. The percussion instrument of claim 21, wherein at least one axial end of said shell is axially spaced from the shoulder portion of the adjacent annular groove so as to prevent axial loads from being transmitted to said shell.

* * * * *